US007189125B2

(12) United States Patent
Okuyama

(10) Patent No.: US 7,189,125 B2
(45) Date of Patent: Mar. 13, 2007

(54) POWER SUPPLY SYSTEM FOR WATERCRAFT PROPULSION DEVICE

(75) Inventor: Takashi Okuyama, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/047,511

(22) Filed: Jan. 31, 2005

(65) Prior Publication Data

US 2005/0170708 A1 Aug. 4, 2005

(30) Foreign Application Priority Data

Jan. 29, 2004 (JP) ..... 2004-021675

(51) Int. Cl.
*B63H 21/22* (2006.01)

(52) U.S. Cl. ..... 440/1

(58) Field of Classification Search ..... 440/6, 440/1; 441/1

See application file for complete search history.

(56) References Cited

U.S. PATENT DOCUMENTS 5,488,283 A * 1/1996 Dougherty et al. ..... 307/10.1
5,684,690 A * 11/1997 Levedahl ..... 363/178
5,689,174 A * 11/1997 Pacheco, Sr. ..... 322/16
6,321,707 B1 * 11/2001 Dunn ..... 123/179.3
6,342,775 B1 * 1/2002 Sleder, Sr. ..... 320/116

OTHER PUBLICATIONS

Japan Patent Application No. 2002-307374; Publication No. 2003-200895, Jul. 15, 2003, Yamaha Marine Co. Ltd.

* cited by examiner

*Primary Examiner*—Stephen Avila
(74) *Attorney, Agent, or Firm*—Knobbe, Martens, Olson & Bear, LLP

(57) ABSTRACT

A power supply system for a watercraft propulsion device which ensures stable power supply to operating devices in the watercraft propulsion device. The power supply system for a watercraft propulsion device preferably includes an operating-system drive control circuit for driving and controlling operating mechanisms in the watercraft propulsion device and a battery for supplying power to the operating mechanisms via a power source circuit. The power source circuit preferably includes a plurality of separate independent batteries that are connected to the power source circuit, and a power supply control circuit is provided to supply power to the operating mechanisms using one of the batteries to be selected according to both battery conditions.

14 Claims, 5 Drawing Sheets

POWER SUPPLY SYSTEM FOR WATERCRAFT PROPULSION DEVICE

PRIORITY INFORMATION

This application claims priority from Japanese Patent Application No. 2004021675, filed Jan. 29, 2004, the entire contents of which is hereby incorporated by reference.

BACKGROUND OF THE INVENTION

1. Field of the Inventions

The present inventions relate to a power supply system for a watercraft propulsion device using a battery, and more specifically to a power supply system for regulating the battery power usage of a watercraft propulsion device.

2. Description of the Related Art

Most watercraft include a propulsion device that is controlled by an operator of the watercraft. Rather than controlling the watercraft propulsion device through manual actuation of the watercraft propulsion device, many boats implement electronic systems that permit the operator's input and transmit the input for actuation of the propulsion device.

Some systems connect a watercraft propulsion device such as an outboard motor or stem drive (hereinafter collectively "outboard motor") to the helm of the watercraft or to a remote control station via a Local Area Network (LAN). The LAN transmits an operation control signal from the helm or remote station through a communication line to drive the outboard motor. This allows many devices to be connected and communicate with each other via a single cable, resulting in simplified wiring between the onboard and outboard devices.

SUMMARY OF THE INVENTION

An aspect of at least one of the embodiments disclosed herein includes the realization that if anomalies occur in some of the devices connected via the LAN, such a failure may cause other devices to fail. For example, a control signal for actuators and the like can be transmitted through an independent communication line that is separate from a line used for a condition information signal transmitted to indicators or gauges. A larger amount of electric power is required to drive the operating devices or actuators compared to the power needed for indicators and gauges. Thus, this arrangement may result in a decrease in capacity of battery or power source as well as in battery failure while driving the watercraft, which could interrupt operation of the outboard motor.

Accordingly, in accordance with various features and embodiments disclosed herein, a power supply system can have two batteries or power sources, one of which supplies electric power to the operating devices and can be switched to the other when its capacity has decreased. This arrangement ensures stable power supply to operating devices in the outboard motor.

In accordance with an embodiment, a power supply system for a watercraft propulsion device is provided. The power supply system comprises a plurality of batteries configured to provide power to the watercraft propulsion device, the plurality of batteries being electrically connected to the watercraft propulsion device. A steering drive unit is configured to control directional movement of the watercraft, the steering drive unit being electrically connected to the plurality of batteries and configured to receive power therefrom. A central processing unit is configured to control power supply from the plurality of batteries to the steering drive unit and watercraft propulsion device based on the respective input of the conditions of the respective batteries. Additionally, the power supply system includes a power supply circuit that receives power from the plurality of batteries through an independent line from each of the plurality of batteries and provides information concerning the conditions of the respective batteries to the central processing unit. The system is configured such that power is supplied to the steering drive unit and the propulsion device by a first battery until the power of the first battery falls below a specified level, whereupon the central processing unit instructs the system to switch supply of power to the steering drive unit and the propulsion device to a second battery, thereby permitting the first battery to be recharged.

In accordance with another embodiment, a method for operating a power supply system of a watercraft is provided. The method comprises connecting a plurality of batteries to a switching circuit of the power supply system, connecting a first battery to a motor driver through the switching circuit such that during operation of the watercraft, power from the first battery is supplied to the motor driver, the switching circuit being configured to detect battery voltage and electric current from the motor and determine the battery condition based on the detected voltage and current, the switching circuit further being configured to determine whether the battery condition is lower than a specified condition, disconnecting the first battery from connection with the motor driver through the switching circuit such that power from the first battery is not supplied to the motor driver when the battery condition of the first battery is lower than a specified condition, and connecting a second battery to the motor driver through the switching circuit such that power from the second battery is supplied to the motor driver. The switching circuit continues to detect the battery voltage connected to the motor driver during operation of the watercraft to determine whether the battery powering the motor driver has a battery condition lower than a specified condition.

In accordance with yet another embodiment, a power supply system for a watercraft propulsion device is provided. The power supply system comprises an operating-system drive control circuit for driving and controlling an operating mechanism of the watercraft propulsion device. A plurality of separate independent batteries are connected to a power source circuit so as to supply power to the operating mechanism. Additionally, a power supply control circuit configured to supply power to the operating mechanism using one of the batteries to be selected according to battery conditions.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

With reference to the figures, certain aspects will be described, which aspects provide a power supply system for providing power supply to a watercraft propulsion device by switching among a plurality of batteries.

Figure 1:
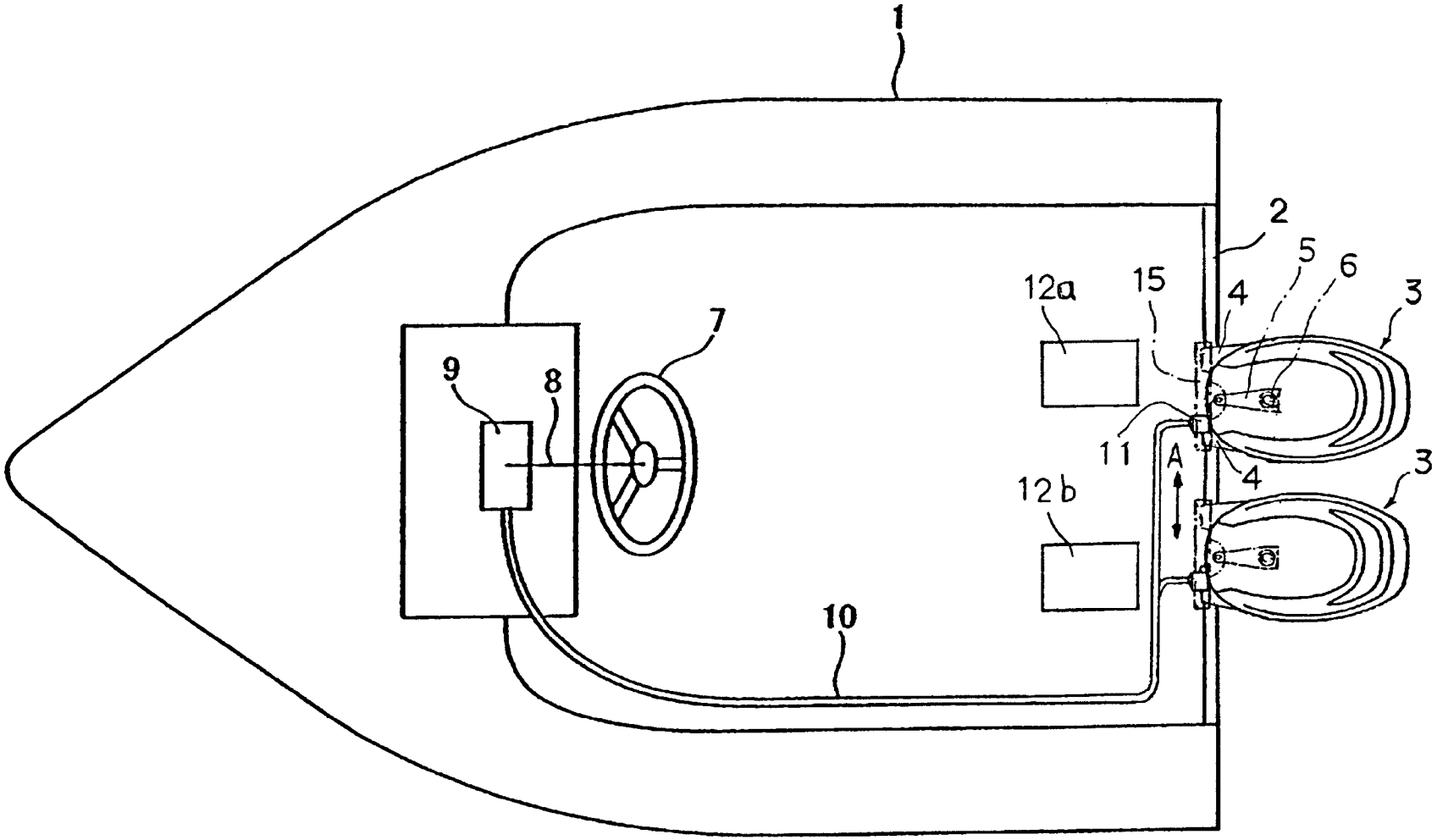
FIG. 1 is an overall plan view of a watercraft having two outboard motors and a power supply system according to an embodiment.

FIG. 1 illustrates an overall plan view of a watercraft having a plurality of outboard motors embodying features disclosed herein. The embodiments disclosed herein are described in the context of a dual outboard motor marine propulsion system for a small boat because these embodiments have particular utility in this context. However, the embodiments and inventions herein can also be applied to boats having only one or three or more outboard motors, as well as other marine vessels, such as personal watercraft and small jet boats, and other vehicles having one or a plurality of engines.

The small watercraft of FIG. 1 can comprise a hull 1 that has two outboard motors 3. The outboard motors 3 can be identical in construction and mounted to a transom plate 2 of the hull 1. Thus, hereinafter, only one of the outboard motors 3 will be described, with the understanding that the other outboard motor 3 can have the same or similar construction.

Two clamp brackets 4 can be used to mount the outboard motor 3 to the transom plate 2. The outboard motor 3 is also rotatable about a swivel shaft 6. The swivel shaft 6 can have an upper end with a steering bracket 5 fixed thereto. The steering bracket 5 can have an end connected to a steering drive unit 15.

The steering drive unit 15 can include, for example, a Direct Drive (DD) type motor mounted on a ball screw (not shown). Displacement of each DD-type motor along the ball screw in a direction indicated by the arrow A allows the steering bracket 5, which is connected to this motor, to rotate about the swivel bracket 6 and thus steer the outboard motor 3.

A steering wheel 7 is provided in front of an operator's seat or "helm" of the hull 1. The degree of operator's steering wheel displacement can be detected by a steering angle detecting device 9 through a steering shaft 8. The steering angle detecting device 9 can be provided within an electronic control unit (ECU) configured for steering operations and which can include a microcomputer (not shown).

The detected degree of operator's steering displacement can be sent from the ECU to a controller 11 of the outboard motor via a cable 10, as a steering angle signal, which can be an electric signal. The controller 11 is configured to drive the steering drive unit 15 based on the steering angle signal to allow the outboard motor 3 to rotationally move about the swivel shaft 6 to steer the hull 1.

In the illustrated embodiment, two independent batteries 12*a* and 12*b* are mounted onboard, one of which is selectively used to supply power to each operating mechanism for these two outboard motors 3, described in greater detail below. The present inventions are not limited to a hull equipped with two outboard motors. The hull 1 can be equipped with a single outboard motor having two batteries, one of which is selectively used. In other embodiments, the hull 1 can be equipped with more than two outboard motors. Also, the hull 1 can be equipped with more than two batteries for operation.

Figure 2:
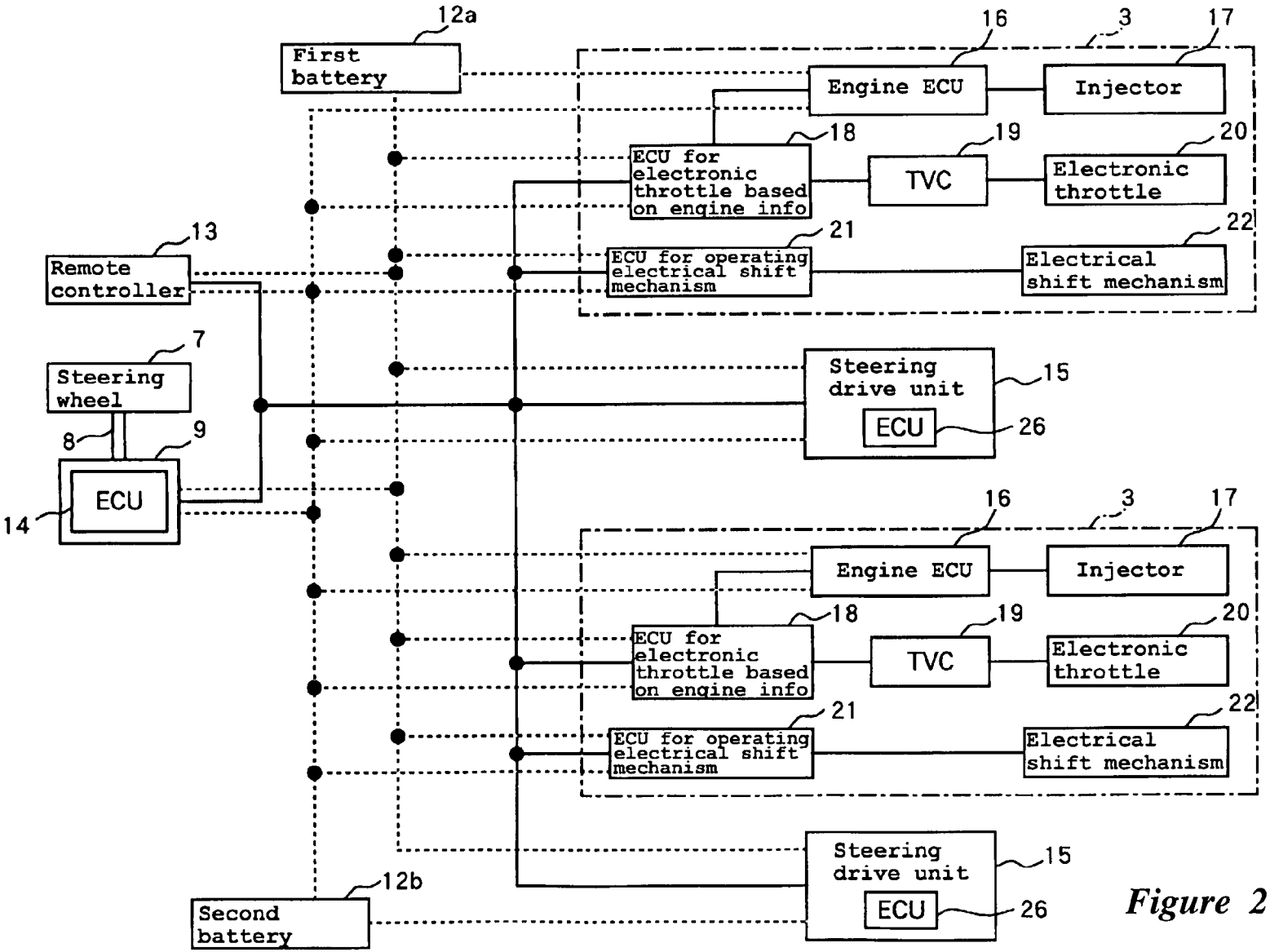
FIG. 2 is a block diagram of an operating system including the power system of FIG. 1.

FIG. 2 is a block diagram of an exemplary operating system for the outboard motors 3 of FIG. 1, both of the outboard motors 3 being illustrated in FIG. 2. Dotted lines and solid lines, which interconnect blocks, respectively indicate a power supply line, and a communication line for operation signal or a transmission line for drive control signal. The communication line is established through the LAN or Controlled Area Network (CAN). In addition to the communication line for the operating mechanism shown in the figure, the outboard motor is provided with another independent transmission line for transmission of signals indicative of information regarding various detected driving conditions to meters, indicators, and/or gauges, although they are not shown.

The steering angle detecting device 9 is configured to detect steering angles of the steering wheel 7 through the steering shaft 8. The steering angle detecting device 9 can include an electronic control unit (ECU) 14 for steering operations. The ECU 14 can be constituted by a microcomputer (not shown). Such steering operations can be implemented by a remote operating station 13 other than the steering wheel 7.

Two DC 12V batteries 12*a* and 12*b* are individually connected to both the remote station 13 and the ECU 14 for steering operations. The remote station 13 and the ECU 14 can be connected via the communication line to each operating system for the two outboard motors 3, which can be identical or similar in construction.

Each outboard motor 3 can include a fuel delivery system. In the illustrated embodiment, the outboard motors 3 include fuel injection systems having at least one fuel injector 17, although other types of fuel systems can also be used. An electronic control unit (ECU) 16 is configured to control engine operation including the injector 17.

The ECU 16 is also connected to an ignition coil (not shown) for ignition control. The outboard motor 3 can also have an electronic throttle 20, a throttle valve controller 19 for driving the electronic throttle 20, and an electronic control unit (ECU) 18 configured to operate; open and close, the electronic throttle based on the information for various engine driving conditions. The outboard motor 3 can also have an electrical shift mechanism 22 and an electronic control unit (ECU) 21 configured to control operations of the electrical shift mechanism.

Each outboard motor 3 is provided with a steering drive unit 15. As previously noted, each steering drive unit 15 includes, for example, a DD-type motor mounted on a ball screw (not shown). As shown in FIG. 1, displacement of each DD-type motor along the ball screw in a direction shown by the arrow A allows the steering bracket 5, which is connected to this motor, to rotate about the swivel bracket 6 to steer the outboard motor 3.

The steering drive unit 15 can include an electronic control unit (ECU) 26 for steering control. To the ECU 26, information regarding a steering wheel angle, that is, the angle by which the operator rotates the steering wheel 7, is transmitted from the ECU 14 in the steering angle detecting device 9, or information for steering angle and shift position is transmitted from the remote controller 13. Based on the aforementioned information regarding steering wheel angle, the ECU 26 drives the DD-type motor to rotate the outboard motor 3 about the swivel shaft in order to steer the watercraft. The first and second batteries 12*a* and 12*b* are individually connected to the ECUs 14, 16, 18, 21 and 26 in each operating mechanism for both the outboard motors 3 through the independent lines.

Figure 3:
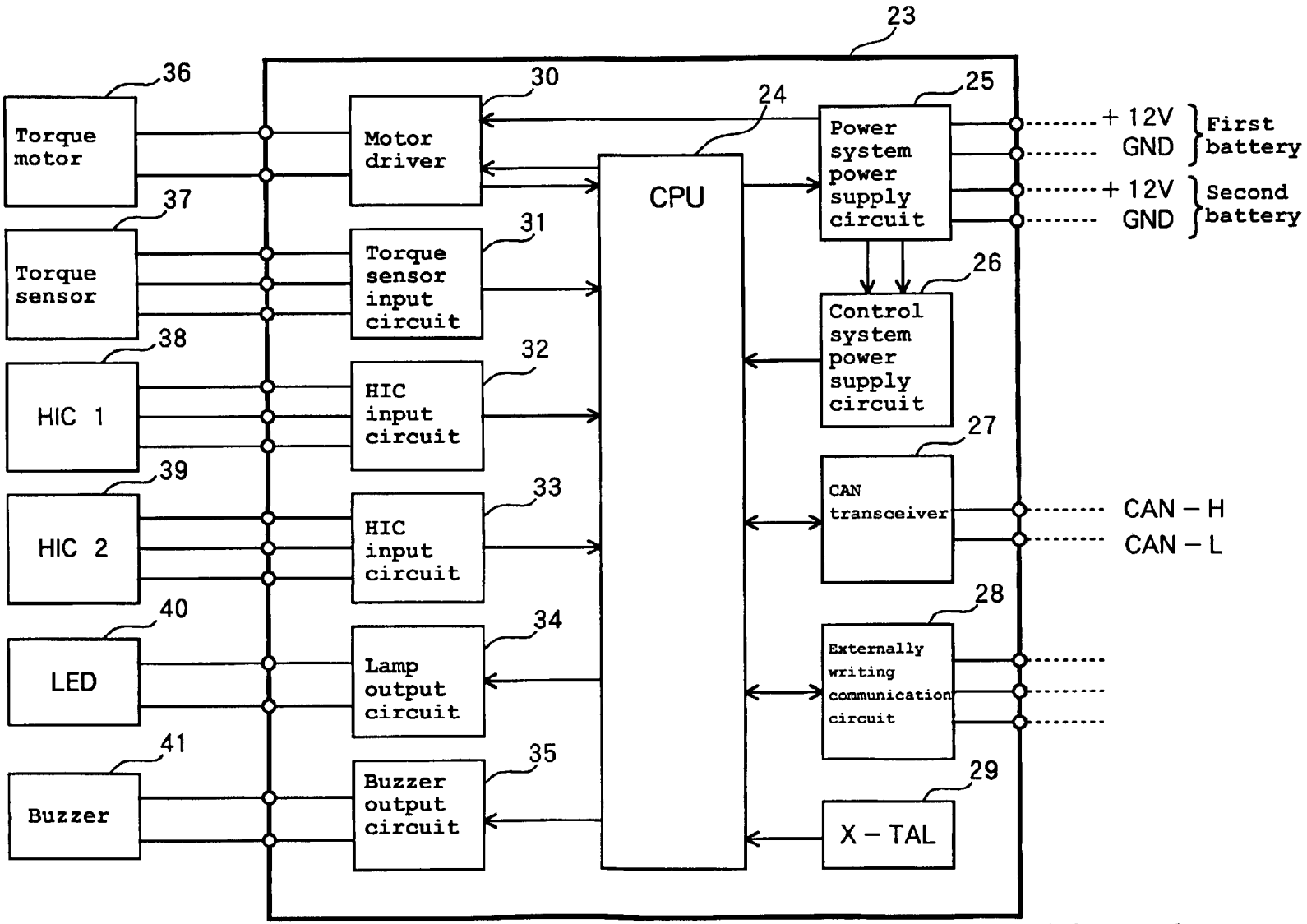
FIG. 3 is a schematic diagram of an Electronic Control Unit configured for use with the power system of FIG. 1.

FIG. 3 is a schematic diagram of an exemplary ECU 23 configured to selectively switch from one battery to the other according to an embodiment. The ECU 23 can include a central processing unit (CPU) 24 which can include a microcomputer with a stored steering control program. Preferably, the ECU 23 also includes a power system power supply circuit 25, a control system power supply circuit 26, a CAN transceiver 27, an external writing communication circuit 28, an oscillating circuit 29, a motor driver 30 connected to a torque motor 36, a torque sensor input circuit 31 connected to a torque sensor 37, two HIC (hall element) input circuits 32 and 33 connected to HICs 38 and 39, respectively, a lamp output circuit 34 connected to a light-emitting diode ("LED") 40, and a buzzer output circuit 35 connected to a buzzer 41.

The first and second batteries 12*a* and 12*b* are preferably connected to the power system power supply circuit 25. The power system power supply circuit 25 inputs power from the first and the second batteries to the control system power supply circuit 26 through two separate lines, and supplies power from either of the batteries to the motor driver 30 through a switching circuit, such as a relay (not shown), in accordance with a command from the CPU 24. A battery switching program in the CPU 24 can be configured such that one of the two batteries is connected as a driving power supply to the motor driver 30 through the switching circuit when the engine is started, or when the watercraft leaves a port. Additionally, the program can be configured to, when battery power is decreased in one battery during running, the other battery is selected for connection with the motor driver 30. In another embodiment, a battery selecting program in the CPU 24 can be configured such that a comparison is made in function between the two batteries, based on their respective voltage and electric current to the motor and/or on their respective residual amounts, and then the battery with higher function is selected.

Accordingly, in an exemplary but non limiting embodiment, immediately after the power is turned on and before the watercraft leaves a port, the two battery power supplies are each checked for capacity and function, and the motor is checked for operability. The operator is then notified about any abnormalities by the LED, the buzzer, or any other device or method for advising an operator about an abnormality so that the operator can decide if such abnormalities should be addressed before leaving a port.

The control system power supply circuit 26 can be configured to separate the two-line battery power from the power system power supply circuit 25. For example, the control system power supply circuit 26 can include a diode or the like to permit one-way electric flow. Additionally, control system power supply circuit 26 can be configured to transmit the two-line battery power to the CPU 24, and to provide a constant-voltage function of, for example, converting the two-line battery power into appropriate voltage required for operating the CPU 24.

The motor driver 30 can be configured to amplify a PWM control signal from the CPU 24 by the battery power supplied from the power system power supply circuit 25 through the switching circuit. The motor driver 30 can also be configured to provide a function of controlling the operation of the DD-type motor for the steering drive unit 15, and a function of transmitting electric current from this motor to the CPU 24.

Figure 4:
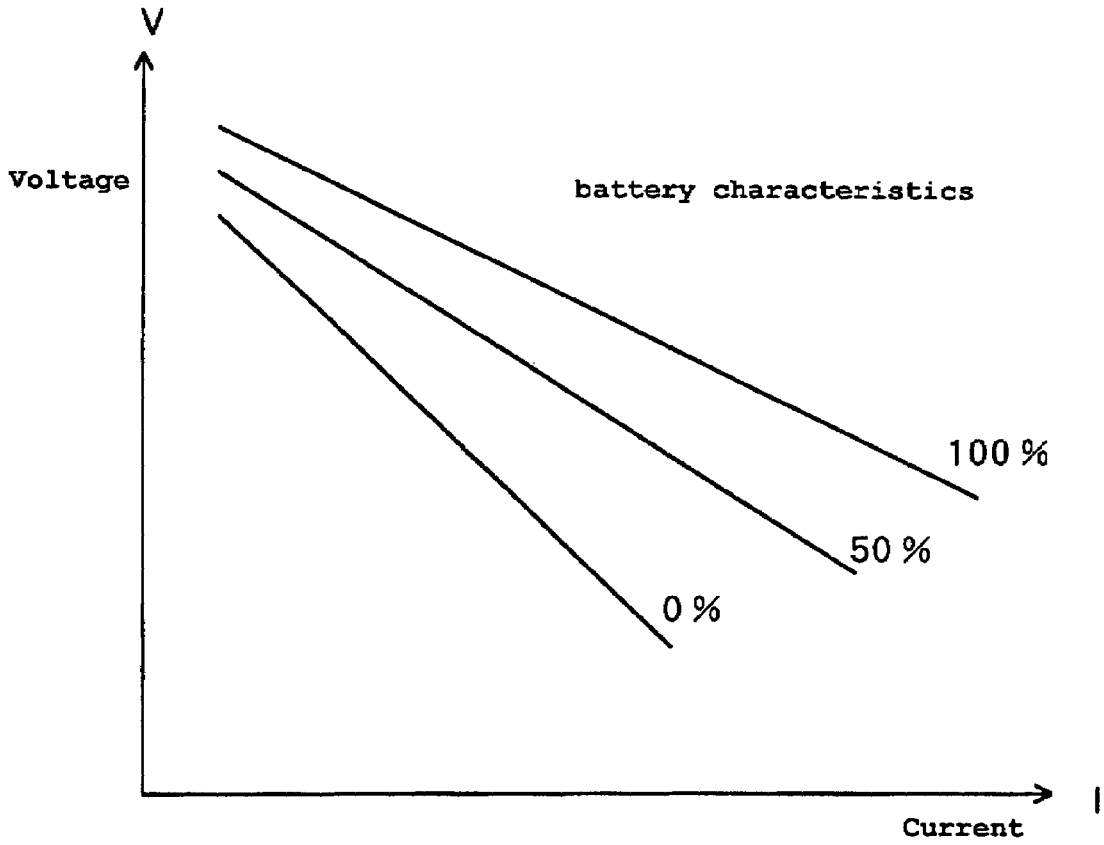
FIG. 4 is a graph illustrating exemplary battery characteristics of the batteries included in the power system of FIG. 1.

The CPU 24 can be configured to detect battery voltage supplied to the torque motor (DD-type motor for steering operations) 36 to determine a degree of decrease in battery function, based on the values for battery voltage and electric current from the motor. For example, the CPU 24 and/or the program can be configured to compare the detected voltage and/or currents with, for example, data indicating battery electric current and voltage characteristics and battery capacity. FIG. 4 includes an exemplary data graph a graph indicating battery-electric current-voltage characteristics by battery capacity.

The CPU 24 can be configured to transmit a power supply switching command to the power system power supply circuit 25 when battery function is decreased to or below a specified value or "predetermined threshold". Simultaneously, the CPU 24 can be configured to light (or flash) the LED 40 through the lamp output circuit 34 to indicate the decreased battery function and can be configured to activate the buzzer 41 through the buzzer output circuit 35. The CPU can also be configured to send a signal indicating the state of decreased battery function to the helm or remote station 13 through the CAN transceiver 27.

Each residual capacity for the two separate batteries can be detected so that either one of the batteries with higher residual capacity can be selectively used. In the illustrated embodiment, the battery not in use is to be recharged while the watercraft is running.

The external writing communication circuit 28 is a circuit for rewriting the programs in the CPU 24. Reference numeral 29 denotes an oscillating circuit for the CPU 24.

The torque sensor 37 is configured to detect reverse torque of the steering wheel 7 and the torque motor 36 when the torque motor 36 is driven in accordance with a steering angle, so as to provide feedback for feedback-control as to whether or not an appropriate steering angle is provided. The HICs 38 and 39 are used as potentiometers for detecting a steering angle. The use of the two HICs 38 and 39 improves reliability of detecting a steering angle.

Figure 5:
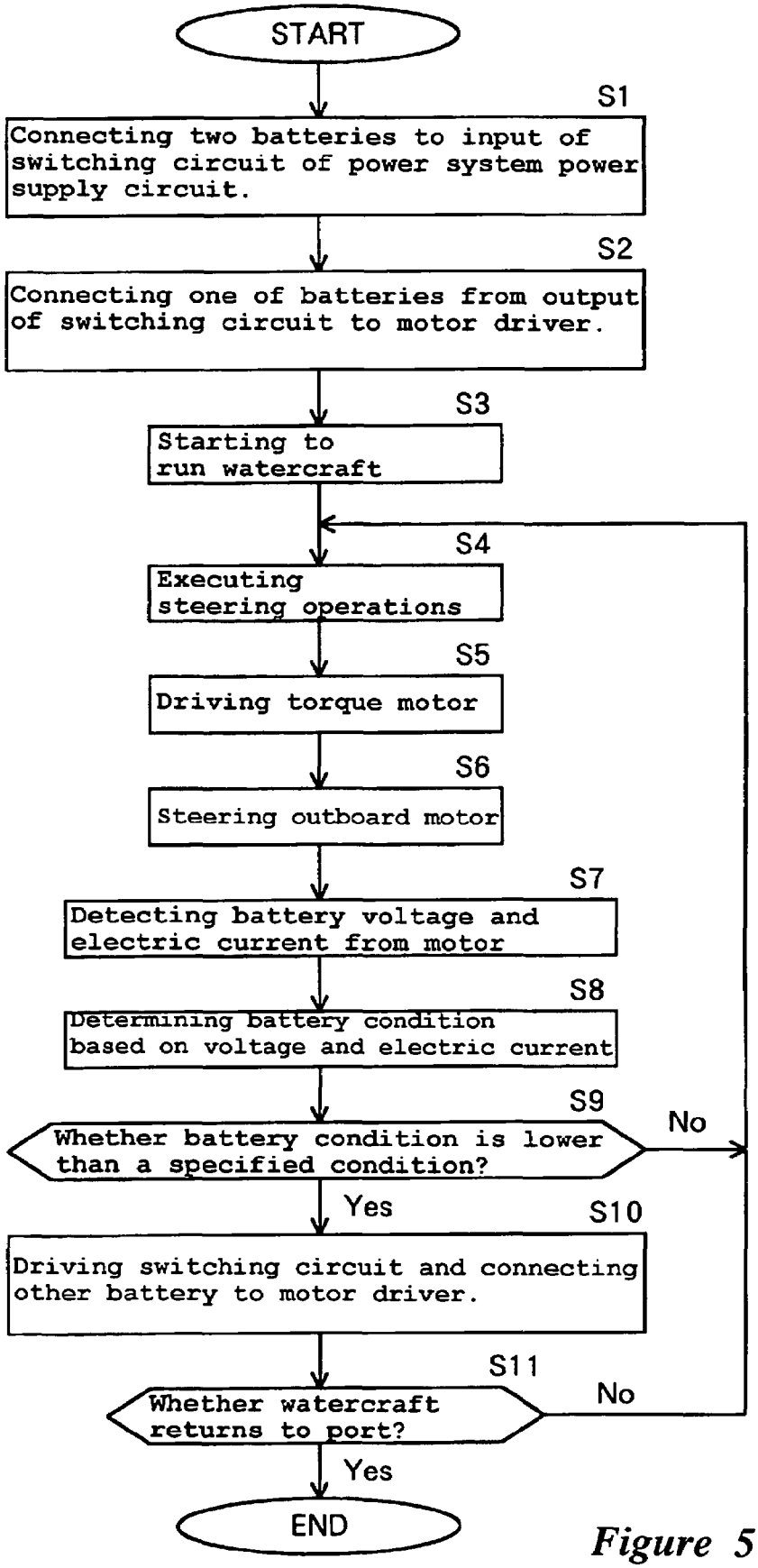
FIG. 5 is a flowchart illustrating a routine that can be used with the power system of FIG. 1.

FIG. 5 illustrates a flowchart showing operations of a power supply system according to the present invention. Operations in each step in the flowchart are described as follows.

In step S1, two batteries are connected to the input of the switching circuit of the power system power supply circuit 25 (FIG. 3) in each of the two outboard motors, before the watercraft leaves the port. In step S2, one of the batteries from the output of the switching circuit is connected to the motor driver 30 for driving the torque motor 36 in the steering drive unit. In other words, power is supplied to two units of outboard motors from a single battery.

During step S3, the engine starts so that the watercraft leaves the port or starts running, and in step S4, steering operations are executed by the steering wheel or remote controller. In step S5, the torque motor 36 is driven through the motor driver 30 based on the steering angle.

In step S6, the outboard motor is steered by controlling the torque motor drive through the feedback-control of torque using the torque sensor 37. The voltage of the battery in use and electric current from the torque motor are detected in step S7. In step S8, a battery condition is determined based on the battery voltage and electric current from the torque motor with reference to the graph in FIG. 4.

During step S9, it is determined whether the battery condition is lower than a specified condition, more specifically, whether or not the initial battery capacity has decreased to a specified value. If the battery condition is lower than the specified condition, then the process returns to the Step S4 to repeat the steering operations so that the watercraft continues to run. If the battery condition is not lower than the specified condition, the process then proceeds to step S10.

In step S10, the switching circuit of the power system power supply circuit 25 is driven to connect the other battery to the motor driver 30. This allows power voltage supply to the torque motor 36 from an alternative full-capacity battery, instead of the battery with lower drive performance.

During step S11, it is determined whether the watercraft returns to the port or if the outboard motor is turned off. If the answer is Yes, then the process ends. If the answer is No, then the process goes back to the Step S4 to repeat the steering operations.

The power supply system for a watercraft propulsion device preferably comprises plural batteries that are connected to the power source circuit, one of which is used to supply power to the operating mechanism. The power supply control circuit can be configured to constantly or periodically at regular or irregular cycles, determine a condition of the battery in use to automatically switch it to the other, if its capacity has decreased. This ensures stable power supply to the operating mechanism in the watercraft propulsion device so that the watercraft can run stably.

The power supply system can comprise a drive control circuit for the operating mechanism. The drive control preferably has a function of selecting and switching to the optimal one of plural power sources. Thus, connecting plural batteries to the operating mechanism can provide automatic stable power supply to the operating system through the drive control circuit without the need for additional circuits.

The operating system is preferably configured to permit the steering drive unit to rotate the watercraft propulsion device about a swivel shaft according to the steering angle of the steering wheel 7. The throttle operating device preferably controls opening and closing of the electronic throttle. The shift operating device preferably controls actuating the electrical shift mechanism to shift to the drive, reverse or neutral position. The engine drive unit preferably controls the engine ignition system and/or fuel supply system. Thus, connecting plural batteries to each control circuit in the operating mechanism, allows automatic selection of an optimum battery, thereby ensuring stable power supply.

In some embodiments, the power supply system comprises a control circuit for steering operations, a control circuit for steering drive, a control circuit for throttle operations, a control circuit for shift operations, and a control circuit for engine drive. These control circuits each function as the power supply control circuit. Thus, connecting plural batteries to each control circuit allows automatic selection of an optimum battery, ensuring stable power supply to each operating mechanism.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments can be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A power supply system for a watercraft propulsion device, the power supply system comprising:

a plurality of batteries configured to provide power to the watercraft propulsion device, the plurality of batteries being electrically connected to the watercraft propulsion device;

a steering drive unit configured to control directional movement of the watercraft, the steering drive unit being electrically connected to the plurality of batteries and configured to receive power therefrom;

a central processing unit configured to control power supply from the plurality of batteries to the steering drive unit and watercraft propulsion device based on the respective input of the conditions of the respective batteries; and a power supply circuit that receives power from the plurality of batteries through an independent line from each of the plurality of batteries and provides information concerning the conditions of the respective batteries to the central processing unit;

wherein the system is configured such that power is supplied to the steering drive unit and the propulsion device by a first battery until the power of the first battery falls below a specified level, whereupon the central processing unit instructs the system to switch supply of power to the steering drive unit and the propulsion device to a second battery, thereby permitting the first battery to be recharged.

2. The power supply system of claim 1, wherein the plurality of batteries comprises two batteries.

3. The power supply system of claim 1, wherein the watercraft propulsion device comprises a plurality of outboard motors.

4. The power supply system of claim 3, wherein the first and second batteries are configured to be independently connected to the plurality of outboard motors.

5. The power supply system of claim 1, wherein when the second battery falls below a specified level, the central processing unit is configured to instruct the system to switch supply of power to the steering drive unit the and propulsion device to the first battery, thereby permitting the second battery to be recharged.

6. The power supply system of claim 1, further comprising a light-emitting diode and buzzer to provide visual and audio indication of the condition of the battery.

7. A method for operating a power supply system of a watercraft, the method comprising:

connecting a plurality of batteries to a switching circuit of the power supply system;

connecting a first battery to a motor driver through the switching circuit such that during operation of the watercraft, power from the first battery is supplied to the motor driver, the switching circuit being configured to detect battery voltage and electric current from the motor and determine the battery condition based on the detected voltage and current the switching circuit further being configured to determine whether the battery condition is lower than a specified condition;

disconnecting the first battery from connection with the motor driver through the switching circuit such that power from the first battery is not supplied to the motor driver when the battery condition of the first battery is lower than a specified condition; and connecting a second battery to the motor driver through the switching circuit such that power from the second battery is supplied to the motor driver; and providing visual and audio indication to an operator that the first battery condition is lower than a specified condition, wherein the switching circuit continues to detect the battery voltage connected to the motor driver during operation of the watercraft to determine whether the battery powering the motor driver has a battery condition lower than a specified condition.

8. A method for operating a power supply system of a watercraft, the method comprising:

connecting a plurality of batteries to a switching circuit of the power supply system;

connecting a first battery to a motor driver through the switching circuit such that during operation of the watercraft, power from the first battery is supplied to the motor driver, the switching circuit being configured to detect battery voltage and electric current from the motor and determine the battery condition based on the detected voltage and current, the switching circuit further being configured to determine whether the battery condition is lower than a specified condition;

disconnecting the first battery from connection with the motor driver through the switching circuit such that power front the first battery is rot supplied to the motor driver when the battery condition of the first battery is lower than a specified condition; and connecting a second battery to the motor driver through the switching circuit such that power from the second battery is supplied to the motor driver;

wherein the switching circuit continues to detect the battery voltage connected to the motor driver during operation of the watercraft to determine whether the battery powering the motor driver has a battery condition lower than a specified condition, and wherein the switching circuit comprises a central processing unit to detect battery voltage and electric current and determine the battery condition.

9. A power supply system for a watercraft propulsion device, comprising:

an operating-system drive control circuit for driving and controlling an operating mechanism of the watercraft propulsion device;

a plurality of separate independent batteries connected to a power source circuit so as to supply power to the operating mechanism; and a power supply control circuit configured to supply power to the operating mechanism using a first battery to be selected according to battery conditions, each of said separate independent batteries being configured to provide an independent connection to said operating mechanism, and the power supply control circuit being configured to disconnect the first battery from the operating mechanism in response to battery conditions and to connect a second battery to the operating mechanism to supply power to the operating mechanism, said second battery being selected according to battery conditions.

10. The power supply system for a watercraft propulsion device of claim 9, wherein the operating-system drive control circuit functions as the power supply control circuit.

11. The power supply system for a watercraft propulsion device according to claim 9, wherein the operating mechanism includes at least one of a steering drive unit, a throttle operating device, a shift operating device and an engine drive unit.

12. The power supply system for a watercraft propulsion device according to claim 10, wherein the operating mechanism includes at least one of a steering drive unit, a throttle operating device, a shift operating device and an engine drive unit.

13. The power supply system for a watercraft propulsion device according to claim 11, wherein the steering drive unit is connected to a steering angle detecting device of a steering wheel; the steering angle detecting device, the steering drive unit, the throttle operating device, the shift operating device and the engine drive unit comprise a control circuit for steering operations, a control circuit for steering drive, a control circuit fir throttle operations, a control circuit for shift operations, and a control circuit for engine drive, respectively; and the control circuits each function as the power supply control circuit.

14. The power supply system for a watercraft propulsion device according to claim 12, wherein the steering drive unit is connected to a steering angle detecting device of a steering wheel; the steering angle detecting device, the steering drive unit, the throttle operating device, the shift operating device and the engine drive unit comprise a control circuit for steering operations, a control circuit for steering drive, a control circuit from throttle operations, a control circuit for shift operations, and a control circuit for engine drive, respectively; and the control circuits each function as the power supply control circuit.

* * * * *